US005617032A

United States Patent [19]

Inagaki

[11] Patent Number: 5,617,032

[45] Date of Patent: Apr. 1, 1997

[54] MISFIRE DETECTING DEVICE FOR INTERNAL COMBUSTION ENGINE

[75] Inventor: Hiroshi Inagaki, Komaki, Japan

[73] Assignee: NGK Spark Plug Co., Ltd., Negoya, Japan

[21] Appl. No.: 587,927

[22] Filed: Jan. 17, 1996

[30] Foreign Application Priority Data

Jan. 17, 1995 [JP] Japan ..... 7-005105
Jun. 13, 1995 [JP] Japan ..... 7-146350

[51] Int. Cl.[6] ..... F02P 17/00

[52] U.S. Cl. ..... 324/399; 324/388; 123/630; 123/656

[58] Field of Search ..... 324/378, 380, 324/384, 388, 393, 399, 402; 123/479, 481, 630, 643, 647, 650, 655, 656; 73/116, 117.2, 117.3

[56] References Cited

U.S. PATENT DOCUMENTS

| | | | |
|---|---|---|---|
| 5,189,373 | 2/1993 | Murata et al. | 324/399 |
| 5,215,067 | 6/1993 | Shimasaki et al. | 123/630 |
| 5,269,282 | 12/1993 | Miyata et al. | 324/399 X |
| 5,365,910 | 11/1994 | Miyata et al. | 123/627 |
| 5,400,760 | 3/1995 | Miyata et al. | 123/630 |
| 5,493,227 | 2/1996 | Shimasaki et al. | 324/388 X |
| 5,503,132 | 4/1996 | Miyata et al. | 324/388 X |
| 5,548,220 | 8/1996 | Kawatamoto et al. | 324/399 |
| 5,561,239 | 10/1996 | Yasuda | 324/399 X |

FOREIGN PATENT DOCUMENTS

| | | |
|---|---|---|
| 4-148073 | 5/1992 | Japan . |
| 4-339176 | 11/1992 | Japan . |
| 5-65866 | 3/1993 | Japan . |

*Primary Examiner*—Kenneth A. Wieder
*Assistant Examiner*—Diep Do
*Attorney, Agent, or Firm*—Foley & Lardner

[57] ABSTRACT

A misfire detecting device for an internal combustion engine is provided. The misfire detecting device includes high voltage pulse producing means for producing, after spark discharge of a spark plug, a high voltage pulse which is not so high as to cause the spark plug to discharge, voltage applying means for applying the high voltage pulse to a conductive path connecting between a secondary winding of an ignition coil to the spark plug, by way of a reverse current preventing diode and a leakage preventing diode connected to the conductive path or by way of a reverse current preventing diode and the secondary winding of the ignition coil, voltage dividing means for dividing a voltage at a side of the reverse current preventing diode nearer to the conductive line to obtain a divided voltage, misfire detecting means for detecting a misfire on the basis of a decay characteristic of the divided voltage obtained after application of the high voltage pulse, wherein the reverse current preventing diode and the leakage preventing diode or the secondary winding of the ignition coil are connected by means of a shielding wire having an outer conductor for shielding.

26 Claims, 4 Drawing Sheets

MISFIRE DETECTING DEVICE FOR INTERNAL COMBUSTION ENGINE

BACKGROUND OF THE INVENTION

1. Field of the Invention

The present invention relates to a device for detecting a combustion condition or misfire of an internal combustion engine.

2. Description of the Prior Art

Various ignition systems for use in multi-cylinder internal combustion engines are known, for example, as shown in FIG. 4A, there is known a distributor type ignition system which includes an ignition coil 50, a power transistor 52 for making battery current flow through a primary winding 50*a* of the ignition coil 50, an engine control unit (ECU) 54 for driving the power transistor 52 in sequence and in timed relation to the ignition timings of each cylinder #1~#4 and inducing a high voltage for ignition in a secondary winding 50*b* of the ignition coil 50, and a distributor 55 for distributing the high voltage for ignition to spark plugs 56~59 of the respective cylinders #1~#4 of the internal combustion engine sequentially, whereby the ignition system is adapted to distribute the high voltage for ignition to each spark plugs by way of the distributor 55.

As shown in FIG. 4*b*, there is further known a single-ended distributorless ignition system which includes a plurality of ignition coils 61 and 62 corresponding to each cylinders #1 and #2 of an internal combustion engine, power transistors 64 and 65 for making battery current flow through primary windings 61*a* and 62*a* of the ignition coils 61 and 62, and an engine control unit (ECU) 67 for driving the power transistors 64 and 65 one by one and in timed relation to the ignition timings of each cylinders #1 and #2 and inducing a high voltage for ignition in secondary windings 61*b* and 62*b* of the ignition coils 61 and 62, whereby the ignition system is adapted to apply a high voltage for ignition produced at each secondary windings 61*b* and 62*b* to each spark plugs 68 and 69.

Though not shown, there is further known a double-ended distributorless ignition system which is constructed so as to make a secondary winding of an ignition coil be connected at opposite ends thereof to a pair of spark plugs provided to different cylinders and thereby be capable of applying a high voltage for ignition from one ignition coil to two spark plugs simultaneously.

In each of such ignition systems, there is normally incorporated a combustion condition or misfire detecting device which is adapted to detect a combustion condition or misfire of each cylinders of an internal combustion engine on the basis of a waveform of a voltage obtained after spark discharge of the spark plug.

For example, the distributor type ignition system shown in FIG. 4A is provided with a misfire detecting device which consists of a voltage dividing circuit 78 made up of coupling capacitors 71~74 of a small capacity, disposed in a conductive path for applying a high voltage for ignition to the spark plugs 56~59 and capacity, disposed in a conductive path for applying a high voltage for ignition to the spark plugs 56~59 and a capacitor 76 of a relatively large capacity and a resistor 77 which are connected to the coupling capacitors 71~74 at one end and grounded at another end, respectively, and a misfire detecting circuit 80 for detecting a misfire of each cylinders #1~#4 on the basis of a decay characteristic of a divided voltage which is obtained by means of the voltage dividing circuit 78 after ignition or firing of each cylinders #1 ~#4. Further, the single-ended distributorless ignition system is provided with a misfire detecting device which consists of a moltage dividing circuit made up of capacitors 81 and 82 of a small capacity, a capacitor 84 of a relatively large capacity and a resistor 85, and a misfire detecting circuit 87 for detecting a misfire of each cylinders #1 and #2 on the basis of a decay characteristic of a divided voltage obtained by means of the voltage dividing circuit.

However, in the prior art misfire detecting device, the coupling capacitor of a small capacity, constituting part of the voltage dividing circuit, is directly provided to a conductive path (i.e., high tension code) for each spark plug, to which a high voltage for ignition is applied, in order to detect a voltage waveform obtained after spark discharge. Accordingly, it requires coupling capacitors, each of which is of a high withstand voltage and expensive as it goes, by the number corresponding to that of cylinders, thus causing a problem of a high cost. Further, in order to fix the coupling capacitors to the conductive paths (i.e., high tension codes) for the spark plugs, a fixing device only for that end is necessitated. In this connection, a plurality of such fixing devices corresponding in number to the cylinders are in effect necessitated, thus causing a problem of a high cost and a difficult assembling work.

Further, in the double-ended distributorless ignition system in which a high voltage for ignition is applied from one ignition coil to two spark plugs simultaneously, a negative high voltage is applied as a high voltage for ignition to one of the two spark plugs. In the spark plug to which a negative voltage is applied, an electrical resistance between the center electrode and the outer electrode is maintained high even in the case where normal combustion occurs, similarly to the case where a misfire has occurred, so there is caused a problem that it is impossible to correctly distinguish between normal combustion and misfire on the basis of the voltage waveform.

SUMMARY OF THE INVENTION

According to an aspect of the present invention, there is provided a misfire detecting device for an internal combustion engine having an ignition system for interrupting flow of primary current through a primary winding of an ignition coil and thereby inducing a high voltage for ignition in a secondary winding of the ignition coil, and applying the high voltage for ignition to a spark plug provided to an internal combustion engine. The misfire detecting device comprises high voltage pulse producing means for producing, after spark discharge of the spark plug, a high voltage pulse which is not so high as to cause the spark plug to discharge, voltage applying means for applying the high voltage pulse to a conductive path connecting between the secondary winding of the ignition coil to the spark plug, by way of a reverse current preventing diode and a leakage preventing diode connected to the conductive path or by way of a reverse current preventing diode and the secondary winding of the ignition coil, voltage dividing means for dividing a voltage at a side of the reverse current preventing diode nearer to the conductive line to obtain a divided voltage, misfire detecting means for detecting a misfire on the basis of a decay characteristic of the divided voltage obtained after application of the high voltage pulse, wherein the reverse current preventing diode and the leakage preventing diode or the secondary winding of the ignition coil are connected by means of a shielding wire having an outer conductor for shielding. In the above misfire detecting device, the high voltage pulse producing means produces, after spark discharge of a spark plug, a high voltage pulse which is not so high as to cause the spark plug to discharge. The voltage applying means applies the high voltage pulse to the conductive path connecting between the secondary winding of the ignition coil and the spark plug by way of the reverse current preventing diode and the leakage preventing diode or by way of the reverse current preventing diode and the secondary winding of the ignition coil. The voltage dividing means divides the voltage at the conductive path side of the reverse current preventing diode. The misfire detecting means detects a misfire of the internal combustion engine on the basis of the decay characteristic of the divided voltage obtained at the voltage dividing means. When normal combustion has occurred within a cylinder, the resistance between the center electrode and the outer electrode of the spark plug becomes low. On the other hand, when a misfire has occurred, the resistance between the center electrode and the outer electrode of the spark plug is maintained high. Thus, according to the present invention, by applying a high voltage pulse to the conductive path connecting between the secondary winding of the ignition coil and the spark plug and thereby storing a charge in the conductive path, judgment on a misfire of the internal combustion engine can be made on the decay characteristic of the terminal voltage of the reverse current preventing diode. The terminal voltage is caused to decay when the stored charge is discharged through the center electrode of the spark plug, i.e., the divided voltage decays rapidly when normal combustion has occurred and slowly when a misfire has occurred. According to the present invention, the path for application of a high voltage pulse to the conductive path connecting between the secondary winding of the ignition coil and the spark plug, i.e., the path extending from the reverse current preventing diode to the leakage preventing diode or the secondary winding of the ignition coil is constituted by a shielding wire having an outer conductor for shielding. Thus, according to the present invention, the capacity-to-ground of the path for application of a high voltage pulse, extending from the reverse current preventing diode to the leakage preventing diode or the secondary winding of the ignition coil, does not vary largely depending upon a variation of the environment in which it is used, such as dew, and therefore it becomes possible to prevent the accuracy in detection of misfire from being lowered due to a variation of the capacity-to-ground of the path. Further, since the path is shielded by the outer conductor, it becomes possible to prevent outward radiation of strong electromagnetic wave and therefore radio interference from being caused by application of the high voltage pulse.

According to another aspect of the present invention, the shielding wire comprises a center conductor, an outer conductor disposed around the center conductor, and an insulator interposed between the center conductor and the outer conductor. The reverse current preventing diode and the leakage preventing diode are connected by means of the center conductor of the shielding wire. The voltage dividing means has a capacitor connected at one of opposite ends to the outer conductor of the shielding wire and grounded at the other of the opposite ends. A voltage across the opposite ends of the capacitor is inputted as the divided voltage to the misfire detecting means. In a coaxial cable having a center conductor and an outer conductor, there exists between the center conductor and the outer conductor a constant electrostatic capacity which is determined by the dielectric constant of the insulator between the center conductor and the outer conductor, the distance between them, the area of their facing surfaces, the length of the cable, etc. According to the present invention, in place of a capacitor of a high withstand voltage and a small capacity, which is used to constitute a capacitor voltage dividing circuit, the capacity between the conductors of the coaxial cable is used, i.e., the voltage at the conductive path side of the reverse current preventing diode is divided by using the capacity between the conductors of the coaxial cable and the capacity of the diode grounded at one end, and a divided voltage is inputted to the misfire detecting means. Due to this, it becomes possible to prevent a variation of the capacity-to-ground of the path for application of high voltage pulse, thus making it assured accurate detection of misfire whilst making it possible to prevent radio interference and dispense with a capacitor of a high withstand voltage and a small capacity, which is large in volume and expensive and which is otherwise necessitated in constituting the voltage dividing means by a capacitor voltage dividing circuit. So, it can be attained with ease to make the misfire detecting device smaller in size and reduce the cost.

According to a further aspect of the present invention, the shielding wire is a double shielding wire including a center conductor, an intermediate conductor disposed around the center conductor, an outer conductor disposed around the intermediate conductor, a first insulator disposed between the center conductor and the intermediate conductor, and a second insulator disposed between the intermediate conductor and the outer conductor. The reverse current preventing diode and the leakage preventing diode or the secondary winding of the ignition coil are connected by means of the center conductor or the intermediate conductor of the shielding wire. The voltage dividing means has a capacitor connected at one of opposite ends to one of the center conductor and the intermediate conductor, to which the reverse current preventing diode is not connected, and grounded at the other of the opposite ends. A voltage across the opposite ends of the capacitor is applied as the divided voltage to the misfire detecting means. In the double shielding wire, there exists between the center conductor and the intermediate conductor, a constant electrostatic capacity which is determined by the dielectric constant of the insulator between the center conductor and the intermediate conductor, the distance between them, the area of their facing surfaces, the length of the wire, etc. Thus, by connecting the reverse current preventing diode and the leakage preventing diode or the secondary winding of the ignition coil by means of the center conductor or the intermediate conductor and connecting one of the center conductor and the intermediate conductor which is not used for the above connection, to the capacitor grounded at one end, it is adapted to divide the voltage at the conductive path side of the reverse current preventing diode by using the capacity between the center conductor and the intermediate conductor and the capacity of the capacitor. By this, an effect similar to that mentioned above is obtained, and it becomes possible to prevent production of noise (occurrence of radio interference) at the time of application of the high voltage pulse with efficiency and assuredness since the center conductor and the intermediate conductor is shielded by the outer conductor.

According to a further aspect of the present invention, the shielding wire is for example of a parallel two-wire type or the like and comprises a plurality of parallel center conductors, an outer conductor placed around the center conductors, and an insulator disposed between the outer conductor and the respective center conductors. The reverse current preventing diode and the leakage preventing diode or the secondary winding of the ignition coil are connected by means of at least one of the center conductors of the shielding wire. The voltage dividing means has a capacitor connected at one of opposite ends thereof to remaining one of the center conductors which is not connected to the reverse current preventing diode and grounded at the other of the opposite ends. A voltage across the opposite ends of the capacitor is inputted as the divided voltage to the misfire detecting means. In a parallel multi-wire type shielding wire, there exists between the center conductors surrounded by the outer conductor a constant electrostatic capacity which is determined by the dielectric constant of the insulator between the center conductors, the distance between them, the area of their facing surfaces, the length of the wire, etc. Thus, by connecting the reverse current preventing diode and the leakage preventing diode or the secondary winding of the ignition coil by means of at least one of the center conductors and connecting one of the center conductors which is not used for the above connection to the capacitor grounded at one end, it is adapted to divide the voltage at the conductive path side of the reverse current preventing diode by using the capacity between the center electrodes and the capacity of the capacitor. By this, an effect similar to that described above is obtained and it becomes possible to prevent production of noise (occurrence of radio interference) at the time of application of the high voltage pulse with efficiency and assuredness.

According to a further aspect of the present invention, in the case where the shielding wire is a double shielding wire or of a parallel multi-wire type, the outer conductor is grounded. By this, it becomes possible to prevent a variation of the capacity-to-ground of the path for application of high voltage pulse, extending from the reverse current preventing diode to the leakage preventing diode or the secondary winding of the ignition coil, more assuredly, thus making it possible to improve the accuracy in detection of misfire.

According to a further aspect of the present invention, the shielding wire constituting the path which extends from the reverse current preventing diode to the leakage preventing diode or the secondary winding of the ignition coil, comprises an insulator having a relatively low dielectric constant and disposed more adjacent to an outer periphery of the center conductor or outer peripheries of the center conductors and an insulator having a relatively high dielectric constant and disposed more adjacent to an inner periphery of the outer conductor. This is for the purpose that in the case where the capacity-to-ground of the shielding wire is made smaller in order that the high voltage pulse producing means can be smaller in size, the shielding wire can be obtained at a relatively low cost and the workability at the time of connection of wires can be prevented from being deteriorated. That is, in the case where the capacity-to-ground of the shielding wire constituting the path for application of high voltage pulse is large, the high voltage pulse is absorbed by the path and the voltage applied to the spark plug is lowered, so it is necessary to make smaller the source impedance for the high voltage pulse. However, if the source impedance is made smaller, there is caused a problem that the weight of the overall device is increased. Accordingly, from a consideration of this fact, it is desired, in the case where a shielding wire is used for the path for application of high voltage pulse and the capacity-to-ground of the path needs to be stabilized, to make the capacity-to-ground of the shielding wire as small as possible. In the meantime, in order to make smaller the capacity-to-ground of the shielding wire (i.e., the electrostatic capacity of the outer electrode and the center electrode constituting the path for application of the high voltage pulse), it will do to make larger the distance between the center conductor and the outer conductor (i.e., the thickness of the insulator therebetween) or to make smaller the dielectric constant of the insulator. However, in order to make smaller the dielectric constant of the insulator, an expensive insulation material such as Teflon (trademark of Du Pont) must be used, thus causing a problem that the cost of the device is increased. So, it is not realistic to make smaller the dielectric constant of the insulator. On the other hand, in the case where an insulation material such as silicon rubber having a relatively large dielectric constant is used, the shielding wire can be obtained at a relatively low cost, thus, though not causing the above problem, causing the shielding wire to be thicker in its entirety. So, there is caused a problem that the work for wiring, etc. within the engine compartment and for connection of the shielding wire becomes more difficult. Thus, by disposing, in the shielding wire constituting the path for application of high voltage pulse, an insulator which is relatively low in dielectric constant though relatively high in cost, in the place adjacent to the center conductor and an insulator which is relatively high in dielectric constant though relatively low in cost, in the place adjacent to the outer conductor, it becomes possible to meet both requirements for the thickness of the shielding wire (i.e., the workability at the time of connection of the shielding wire) and for the cost of the shielding wire. Thus, according to the present invention, it becomes possible to obtain a shielding wire which is relatively low in capacity-to-ground and enables to set the high voltage pulse at a relatively low value, at a relatively low cost without deteriorating the workability at the time of connection of the wire, etc., and it becomes possible to make smaller in size the misfire detecting device with ease.

In the case where the insulator is constructed to have a dual-walled structure, it will do to use for an insulator adjacent to the periphery of the center conductor an insulation material such as Teflon, which mainly contains fluororesin and which has been heretofore and generally used as an insulation material for an expensive shielding wire, and for an insulator adjacent to the inner periphery of the outer conductor an insulation material which mainly contains silicon rubber and which has heretofore and generally been used as an insulation material for an ordinary shielding wire.

The foregoing structures are effective for solving the above noted problems inherent in the prior art device.

It is accordingly an object of the present invention to provide a novel and improved misfire detecting device which can effect an accurate detection of a misfire at all times, without being affected by a variation of the environment in which it is used.

It is a further object of the present invention to provide a novel and improved misfire detecting device of the aforementioned character which makes it possible to reduce its size and the cost with ease.

DETAILED DESCRIPTION OF THE PREFERRED EMBODIMENT

Figure 1:
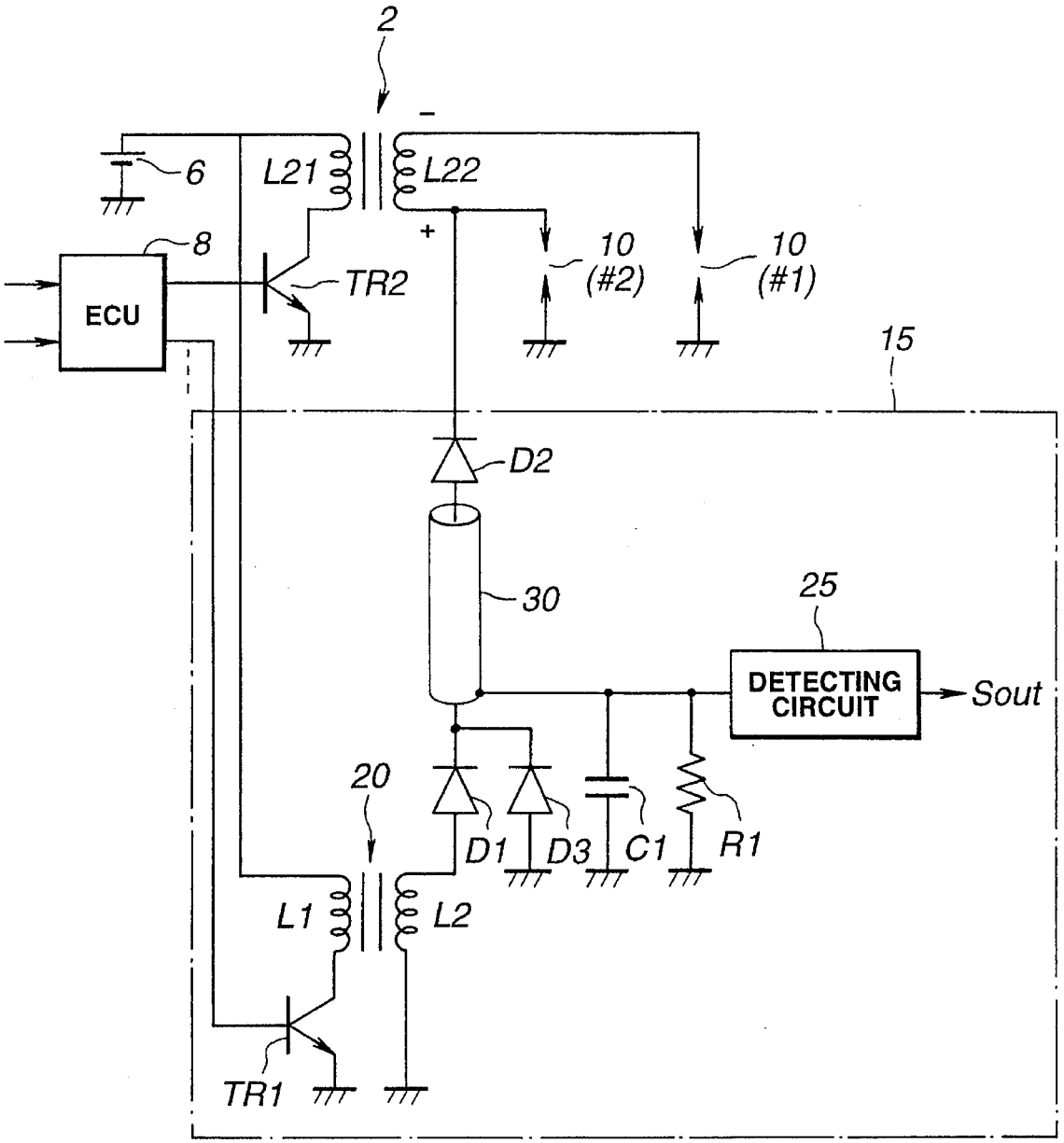
FIG. 1 is a circuit diagram of a double-ended distributorless ignition system having incorporated therein a misfire detecting device according to an embodiment of the present invention.

In order to solve the above noted problems, it has been proposed, as disclosed in Japanese Patent application Nos. 6-205834 and 6-198848 which are assigned to the same assignee of the subject application, a misfire detecting device which is constructed so as to apply a high voltage pulse which is not so high as to cause a spark plug to perform spark discharge, by way of a reverse current preventing diode and a leakage preventing diode for preventing intrusion of a high voltage for ignition or by way of a reverse current preventing diode and a secondary winding of an ignition coil, to a conductive path (i.e., high tension code) connecting between the secondary winding of the ignition coil and the spark plug, divide the voltage at the conductive path side of the reverse current preventing diode, and detect a combustion condition or misfire of each cylinder on the basis of the decay characteristic of the divided voltage.

The proposed device is adapted to utilize the fact that when a high voltage pulse is applied by way of a reverse current preventing diode to an ignition system of each cylinder of an internal combustion engine after spark discharge, for thereby storing a charge in the ignition system, the stored charge is discharged by means of ions existing adjacent the electrodes of the spark plug having caused combustion, causing the terminal voltage at the reverse current preventing diode to decay, and thereby to detect whether the quantity of the ions existing adjacent the electrodes of the spark plug is large or small, i.e., whether the combustion has occurred or not within the corresponding cylinder.

In a distributor type or a single-ended distributorless ignition system, the proposed device can be constructed so that, for example, a high voltage pulse from the reverse current preventing diode is applied by way of the secondary winding of the ignition coil to the spark plug of each cylinder to detect the voltage at the ignition coil side of the reverse current preventing diode by means of one voltage dividing circuit, whereby it becomes possible to detect a misfire at each cylinder, and the structure can be simplified to reduce the cost.

On the other hand, in a double-ended distributorless ignition system, the proposed device can be constructed so that a high voltage pulse is applied by way of a reverse current preventing diode and a leakage preventing diode to a conductive path connecting between the ignition coil and one spark plug to detect a voltage at the junction between reverse current preventing diode and the leakage preventing diode by means of a voltage dividing circuit, whereby it becomes possible to detect the combustion condition or misfire in the cylinders provided with a pair of spark plugs by one voltage dividing circuit, so that it becomes possible to simplify the structure and reduce the cost and furthermore it becomes possible to detect the combustion condition or misfire correctly without being affected by the polarity of a high voltage for ignition.

In the meantime, in the above proposed device, it was revealed that since, in order to apply a high voltage pulse from the reverse current preventing diode to the ignition line for each cylinders, a conductive harness was used to connect therebetween, there happened a case in which a combustion condition or misfire could not be detected correctly due to a variation of environment or circumstance. Hereinafter, the reason why will be described.

In the above proposed device, a charge is stored in the igniting line for each cylinder by way of the reverse current preventing diode, and a combustion condition or misfire is detected depending on the decay characteristic of a divided voltage which decays when the stored charge is discharged by means of the ions adjacent the spark plug. The decay characteristic of the divided voltage varies depending upon a variation of a time constant which is determined by an interelectrode resistance of the spark plug and a capacitance of an igniting line including a charging path extending from the misfire detecting device to the igniting line. Accordingly, in the case where a conductive harness is used for applying a high voltage pulse from the reverse current preventing diode to the igniting line, also the capacitance-to-ground of the conductive harness have an influence on the decay characteristic of the divided voltage.

On the other hand, the capacitance-to-ground of the conductive harness varies under the influence of the water attached to the circumferential periphery of the harness due to dew condensation, etc. For example, in the case where the circumferential periphery of the conductive harness is completely wetted due to dew condensation, etc., the capacitance-to-ground of the harness becomes ten times larger than that obtained when it is dry. As the capacitance-to-ground of the conductive harness increases, the time constant of the path extending from the reverse current preventing diode to the spark plug is caused to increase. In this instance, even if the amount of ions adjacent the electrodes of the spark plug is constant, i.e., even if the interelectrode resistance of the spark plug is constant, the voltage obtained by the voltage dividing circuit changes gradually.

As a result, in the case where a high voltage pulse is applied from a reverse current preventing diode to an igniting line by way of a conductive harness, the capacitance to ground of the conductive harness is liable to change much more depending upon a variation of environment as the conductive harness becomes longer, thus deteriorating the accuracy on detection of a combustion condition or misfire. Further, in the case of the above described conductive harness, application of a high voltage causes a strong electromagnetic wave to radiate from the conductive harness, thus possibly being causative of radio interference noise.

Figure 4A:
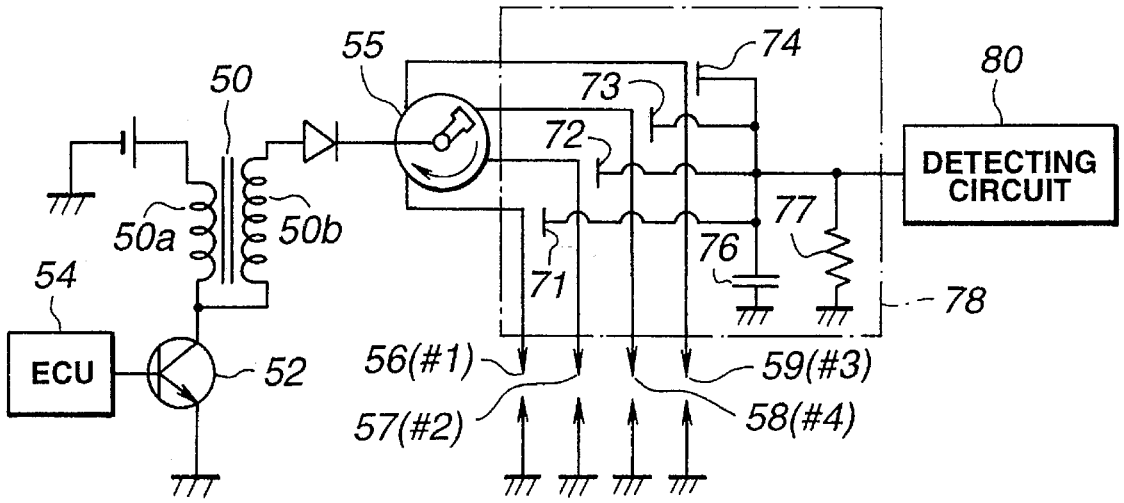
FIGS. 4A and 4B are circuit diagrams of a prior art distributor type ignition system and a prior art single-ended distributorless ignition system, respectively.
Figure 4B:
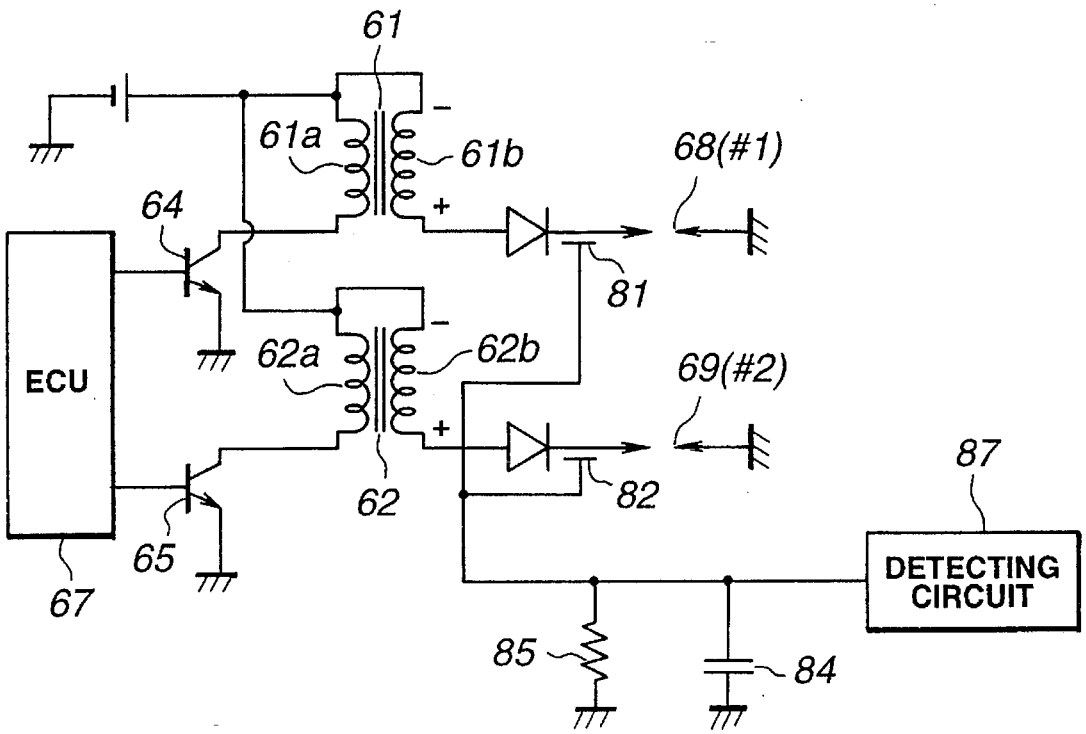

Further, in the above proposed device, a capacitor voltage dividing circuit made up of a capacitor of a small capacity and a capacitor of a relatively large capacity was used in order to detect a decay characteristic of a charged voltage after application of a high voltage pulse, similarly to the prior art devices shown in FIGS. 4A and 4B, so a high voltage is applied, as it is, to the capacitor of a small capacity, which is disposed on the igniting line side of the voltage dividing circuit and therefore it is required that the capacitor be a high withstand voltage capacitor.

However, such a high withstand voltage capacitor is expensive, relatively large in volume and cannot be a surface mounting part which is mounted on a circuit board, etc. Due to this, in the above proposed device, the capacitor of a small capacity, constituting part of the above described capacitor voltage dividing circuit, is an obstacle to reduction of cost, thus causing a problem that it cannot be attained with ease to make the device smaller in size and lower in cost.

Referring now to FIG. 1, a misfire detecting device which is applied to a double-ended distributorless ignition system according to an embodiment of the present invention will be described.

As shown in FIG. 1, the ignition system is provided with an ignition coil 2 for applying a high voltage for ignition (tens of kilovolts) to a pair of spark plugs 10(#1 and #2) of a multi-cylinder internal combustion engine simultaneously. The ignition coil 2 is composed of a primary winding L21 and a secondary winding L22 which are respectively wound on an iron core constructed of laminated thin silicon steel plates and is housed within a case filled with resin. The primary winding L21 is connected at one end to a positive side of a battery 6 and grounded at the other end by way of a power transistor TR2 which is turned on and off in response to an ignition signal derived from an engine control unit (ECU) 8. Further, the secondary winding L22 of the ignition coil 2 is connected at opposite ends thereof to center electrodes of spark plugs 10(#1) and 10(#2) of the respective cylinders #1 and #2 by way of high tension codes. In the meantime, outer electrodes of the spark plugs 10(#1) and 10(#2) are grounded.

Then, to one of the opposite ends of the above described ignition coil 2, from which a high voltage for ignition is applied to a center electrode of one spark plug 10(#2) when the power transistor TR2 is turned off and a positive high voltage is produced, a high voltage pulse deriving from a combustion condition or misfire detecting device 15 is applied.

The misfire detecting device 15 is provided with a high voltage pulse producing coil 20 which is made up of a primary winding L1 and a secondary winding L2. The primary winding L1 of the coil 20 is connected at one end to the positive side of the battery 6 and grounded at the other end by way of a power transistor TR1 which is turned on and off in response to a signal from the engine control unit (ECU) 8. Further, one of the opposite ends of the secondary winding L2 of the coil 20, which is positioned on the side where a positive voltage is induced when the power transistor TR1 is turned off, is connected by way of a reverse current preventing diode D1 and a leakage preventing diode D2 to the spark plug 10(#2) side end of the above described ignition coil 2, and the other end is grounded.

As a result, when the power transistor TR1 is turned on and off in response to a signal deriving from the engine control unit (ECU) 8 and a high voltage is induced in the secondary winding L2 of the coil 20 at the time when the power transistor TR1 is turned off, the induced voltage is applied as a positive high voltage pulse (about 3 kilovolts in this embodiment) to the spark plug 10(#2) side end of the ignition coil 2. That is, in this embodiment, a high voltage producing means is constituted by the coil 20 and the power transistor TR1, and a voltage applying means is constituted by the reverse current preventing diode D1 and the leakage preventing diode D2.

Figure 2A:
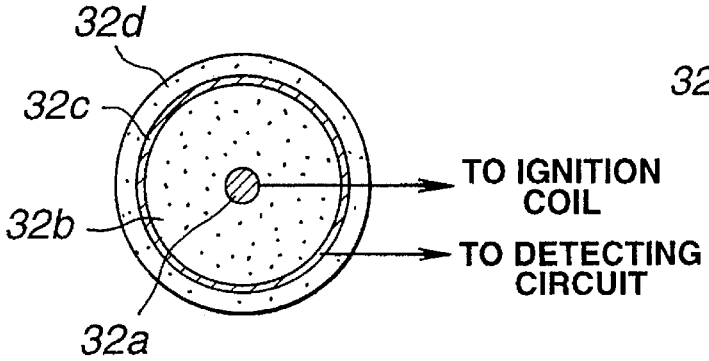
FIGS. 2A, 2A', 2B, 2C and 2C' are sectional views of various shielding wires for use in the misfire detecting device of FIG. 1.
Figure 2A:
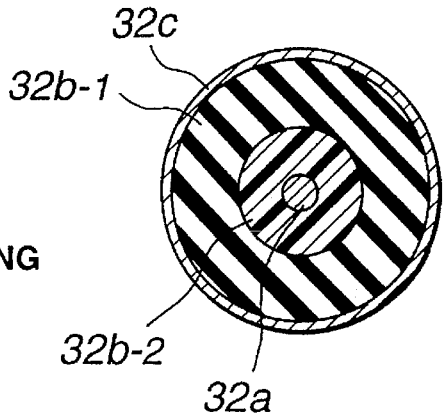

Further, the cathode of the reverse current preventing diode D1 and the anode of the leakage preventing diode D2, which constitute the voltage applying means in the above manner, are connected to each other by means of a central conductor of a shielding wire (coaxial cable) consisting of, as shown in FIG. 2A, a center conductor 32*a*, a conducting tube or outer conductor 32*c* disposed around the center conductor 32*a* whilst being provided with an insulator 32*b* therebetween, and an insulation cover material 32*d* covering the outer conductor 32*c*.

To the outer conductor 32*c* of the shielding wire 30, a parallel circuit consisting of a capacitor C1 of a relatively large capacity (about 2500~5000 picofarads for instance) grounded at one end and a resistor R1 of a relatively large resistance (10MΩ for instance) is connected. The junction between this parallel circuit and the outer conductor 32*c* is connected to a detecting circuit 25 which serves as a misfire detecting means and detects a combustion condition of each cylinders #1 and #2 after completion of spark discharge on the basis of a decay characteristic of a voltage at that junction and outputs a detection signal Sout.

In the meantime, in FIG. 1, a diode D3 which is connected at the cathode thereof to the cathode of the reverse current preventing diode D1 and grounded at the anode, is provided for preventing an excessively high negative voltage from being applied to a conductive path for application of positive voltage, which extends from the secondary winding L22 of the ignition coil 2 to the spark plug 10(#2), and is desired to be arranged but can be dispensed with.

In the misfire detecting device 15 of this embodiment, structured as above, the power transistor TR1 is turned off after spark discharge at each cylinders #1 and #2 in response to a signal deriving from the engine control unit (ECU) 8. Then, a high voltage is induced in the secondary winding L2 of the coil 20 in the above described manner and is applied as a high voltage pulse by way of the reverse current preventing diode D1, the shielding wire 30 and the leakage preventing diode D2 to the spark plug 10(#2) side end of the secondary winding L22 of the ignition coil 2.

As a result, a charge is stored in the secondary winding L22, the high tension codes extending from the secondary winding L22 to the spark plugs 10(#1) and 10(#2), and the shielding wire 30 connecting between the reverse current preventing diode D1 and the leakage preventing diode D2.

The stored charge is discharged through the electrodes of the spark plug 10(#1) or 10(#2) after spark discharge thereof. Thus, in the case where normal combustion has occurred in the cylinder #1 or #2 after spark discharge thereat, the voltage at the cathode side of the reverse current preventing diode D1 decays rapidly. On the contrary, in the case where normal combustion has not occurred in the cylinder #1 or #2 after spark discharge thereat due to a misfire, etc., the cathode side voltage does not decay rapidly.

On the other hand, the reverse current preventing diode D1 and the leakage preventing diode D2 are connected to each other by means of the shielding wire 30 made up of a coaxial cable, and there exists between the center conductor 32*a* and the outer conductor 32*c* an electrostatic capacity which is determined by the dielectric constant of the insulator 32*b*, the distance between the center conductor 32*a* and the outer conductor 32*c* and the area of the facing surfaces thereof, the length of the wiring, etc. Due to this, the voltage at the cathode side of the reverse current preventing diode D1 is divided by the ratio of the capacity between the center conductor 32*a* and the outer conductor 32*c* to the capacity of the capacitor C1 connected to the outer conductor 32*c*, and the divided voltage is inputted to the detecting circuit 25.

On the basis of the decay characteristic of the divided voltage, the detecting circuit 25 detects a combustion condition in the cylinder #1 or #2 after spark discharge thereat and outputs a detection signal Sout in accordance with the combustion condition.

In the meantime, although the capacitor C1 is connected with the resistor R1, the resistor R1 is of a high resistance and thus does not cause any influence to the transient decay characteristic of the divided voltage after application of the high voltage pulse.

As having been described as above, in the misfire detecting device 15 of this embodiment, a coaxial cable is used for connection between the reverse current preventing diode D1 and the leakage preventing diode D2, and these diodes are connected to the center conductor 32*a* of the shielding wire 30, so that the capacity-to-ground of the path extending from the reverse current preventing diode D1 to the ignition coil 2 does not vary largely depending upon a variation of an environmental condition such as dew and it becomes possible to prevent deterioration of the detection accuracy due to a variation of the capacity-to-ground of that path. Further, the path is shielded by the outer conductor 32*c* so that there is not caused any strong electromagnetic wave radiating outward by the application of the high voltage pulse.

Further, as described above, in this embodiment, in order that the decay characteristic of the high voltage pulse after application thereof can be detected by the detecting circuit 25, the voltage at the cathode side of the reverse current preventing diode D1 is divided by the ratio of the capacity between the center electrode 32*a* and the outer electrode 32*c* of the shielding wire 30 to the capacity of the capacitor C1, whereby a voltage dividing means can be constituted by a capacitor voltage dividing circuit without requiring additional provision of a capacitor of a small capacity and of a high withstand voltage which is large in volume and expensive and therefore it becomes possible to make the device smaller in size and reduce the cost thereof.

Figure 2B:
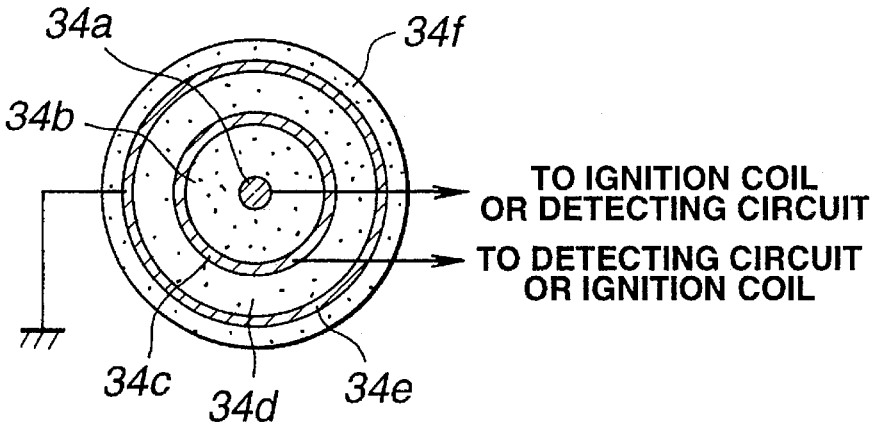
Figure 2C:
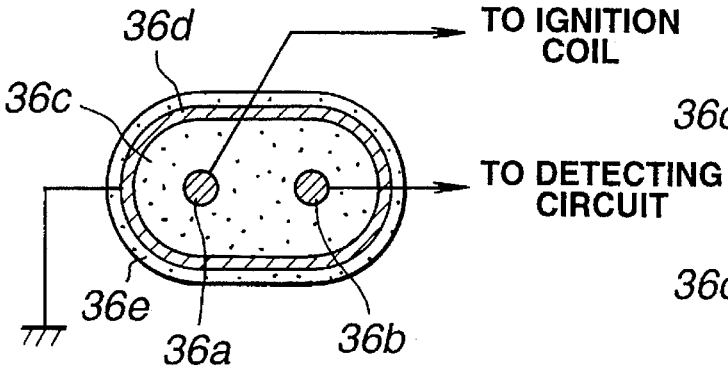
Figure 2C:
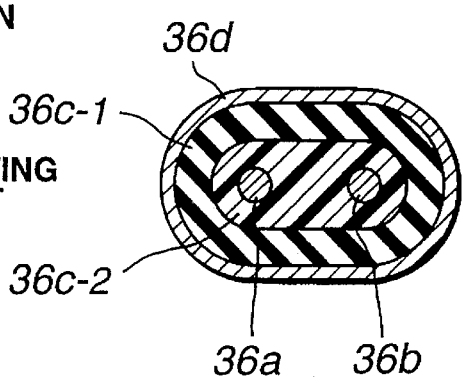

While the shielding wire 30 is used in this embodiment for connection between the reverse current preventing diode D1 and the leakage preventing diode D2, it can be substituted for, as for example shown in FIG. 2B, a double shielding wire constructed so as to dispose around a center conductor 34*a* an intermediate conductor 34*c* whilst interposing therebetween an insulator 34*b*, dispose an outer conductor 34*e* around the intermediate conductor 34*c* whilst interposing therebetween an insulator 34*d*, and cover the outer conductor 34*e* by means of an insulation cover material 34*f*, or as shown in FIG. 2C, a parallel two-wire type shielding wire constructed so as to dispose two center conductors 36*a* and 36*b* in parallel to each other whilst interposing therebetween an insulator 36*c* and dispose an outer conductor 36*d* around the center conductors 36*a* and 36*b* whilst covering the outer conductor 36*d* by an insulation cover material 36*e*.

In the case where the double shielding wire is employed, by connecting the reverse current preventing diode D1 and the leakage preventing diode D2 by means of the center electrode 34*a* for thereby constituting a path for application of a high voltage pulse by means of the center conductor 34*a* and by using the intermediate conductor 34*c* as a path for outputting of a divided voltage to the detecting circuit 25, an effect similar to that of the above described embodiment can be attained. Further, in this instance, since the intermediate conductor 34*c* is shielded by the outer conductor 34*e*, it becomes possible to constitute a path for application of a high voltage pulse to the ignition coil 2 by means of the intermediate conductor 34*c* and use the center conductor 34*a* as a path for outputting of a divided voltage to the detecting circuit 25.

Further, in the case where the parallel two-wire type shielding wire is employed, by connecting, as for example shown in FIG. 2C, the reverse current preventing diode D1 and the leakage preventing diode D2 by means of one center conductor 36*a* for thereby constituting a path for application of a high voltage pulse to the ignition coil 2 by means of the center conductor 36*a* and by using the other center conductor 36*b* as a path for output of a divided voltage to the detecting circuit 25, an effect similar to that of the previous embodiment is obtained.

In the case of employment of a shielding wire having a plurality of conductors inside an outer conductor, not only by using the inner conductors as paths for application of a high voltage pulse and a divided voltage, respectively but by grounding, the outer conductors 34*e* and 36*d* as shown in FIGS. 2B and 2C, it becomes possible to prevent a variation of the capacity-to-ground of the path for application of high voltage pulse more assuredly, thus making it possible to improve the accuracy in detection of the combustion condition. Further, since the inner conductors are shielded by the outer conductor, production of noise (electro magnetic radiation) can be prevented assuredly.

In the meantime, in the case where the shielding wire 30 is used to connect the cathode of the reverse current preventing diode D1 and the anode of the leakage preventing diode D2 for thereby constituting a path for application of a high voltage pulse, it becomes possible to stabilize the capacity-to-ground of the path for thereby improving the accuracy in detection of the combustion condition. However, when this capacity-to-ground is too large, the high voltage pulse is absorbed by the path so that the voltage applied to the spark plug is lowered. Thus, it is necessary to make higher the voltage produced by the coil 20. To this end, it must be done to increase the number of turns of the primary winding L1 and the number of turns of the secondary winding L2 of the coil 20 and make the coil 20 larger in size so that it can endure production of a higher voltage.

Accordingly, in order to make the coil 20 smaller in size, it is desired to make the capacity-to-ground of the shielding wire 30 as smaller as possible. Particularly, in the case where the shielding wire 30 is used as a capacitor of a high withstand voltage and of a small capacity, constituting a capacitor voltage dividing circuit as in the above described embodiment, there is caused, if it has a large capacity-to-ground, a problem in constituting the capacitor voltage dividing circuit. For this reason also, it is desired to make the capacity-to-ground of the shielding wire 30 as small as possible.

In order to make smaller the capacity-to-ground of the shielding wire 30, it will do to make, in the case where the shielding wire 30 is a coaxial cable shown in FIG. 2A, the insulator 32*b* between the center conductor 32*a* and the outer conductor 32*c*, have a dual-walled structure consisting of an insulator section 32*b*-1 made silicon rubber, or the like and having a relatively high dielectric constant and an insulator section 32*b*-2 made of fluororesin such as Teflon and having a relatively low dielectric constant, cover the center conductor 32*a* by the insulator section 32*b*-2 of a low dielectric constant, cover the insulator section 32*b*-2 by the insulator section 32*b*-1 of a high dielectric constant, and dispose the outer conductor 32*c* around the insulator 32*b*-1 of a high dielectric constant.

To the same end, in the case where the shielding wire 30 is of the parallel two-wire type shown for example in FIG. 2C, it will do to make an insulator 36*c* have a dual-walled structure as shown in FIG. 2C', cover the two center conductors 36*a* and 36*b* by an insulator section 36*c*-2 of a low dielectric constant, cover the insulator section 36*c*-2 by an insulator section 36*c*-1 of a high dielectric constant and dispose an outer conductor 36*d* around the insulator section 36*c*-1 of a high dielectric constant.

On the other hand, to the same end, in the case where the shielding wire 30 is of a dual shielding wire shown in FIG. 2B, it will do to form an insulator 34*b* interposed between a center conductor 34*a* and an intermediate conductor 34*c*, from fluororesin such as Teflon, i.e., an insulation material of a relatively low dielectric constant, and form the insulator 34*d* interposed between the intermediate conductor 34*c* and the outer conductor 34*e*, from silicon rubber, EPDM (ethylene propylene dien monomer), or the like, i.e., an insulation material of a relatively high dielectric constant.

In order to make smaller the capacity-to-ground of the shielding wire 30, it will do to make larger the distance between the center conductor 32*a*, 34*a* or 36*a* constituting a path for application of a high voltage pulse and the outer conductor 32*c*, 34*c* or 36*d*, or to make the dielectric constant of the insulator 32*b*, 34*b* or 36*c* interposed therebetween as small as possible. However, when the distance between the center conductor and the outer conductor is made larger, the shielding wire 30 becomes thicker, thus causing a problem of deteriorating the workability in wiring, etc. or making it impossible to carry out wiring within an narrow engine compartment of an automotive vehicle or the like. On the other hand, when the insulator 32*b*, 34*b* and 34*d*, or 36*c* is all formed from an insulation material of a low dielectric constant, there is caused a problem of increasing the cost of the shielding wire 30 and therefore of the misfire detecting device since the insulation material is expensive.

Accordingly, as described in the above, if the insulator 32*b*, 34*b* and 34*d* or 36*c* is made to have a dual-walled structure, the insulator 32*b*-2, 34*b* or 36*c*-2 of a relatively low dielectric constant is disposed on the center conductor 32*a*, 34*a* or 36*a* side, the insulator 32*b*-1, 34*d* or 36*c*-1 of a relatively high dielectric constant is disposed on the outer conductor 32*c*, 34*e* or 36*d* side, a shielding wire 30 of a small capacity-to-ground can be obtained at a relatively low cost, whilst holding down the thickness of the wire so that it does not cause deterioration of the workability. In this instance, particularly in the case of the double shielding wire shown in FIG. 2B, it can be produced with ease since the insulators 34*b* and 34*d* differing in dielectric constant are separated by the intermediate conductor 34*c*.

Further, while the embodiment of this invention has been described and shown with respect to a double-ended distributorless ignition system, it can otherwise be applied to a distributor type ignition system shown in FIG. 4A or a single-ended distributorless ignition system shown in FIG. 4B, to produce the same effect.

Figure 3:
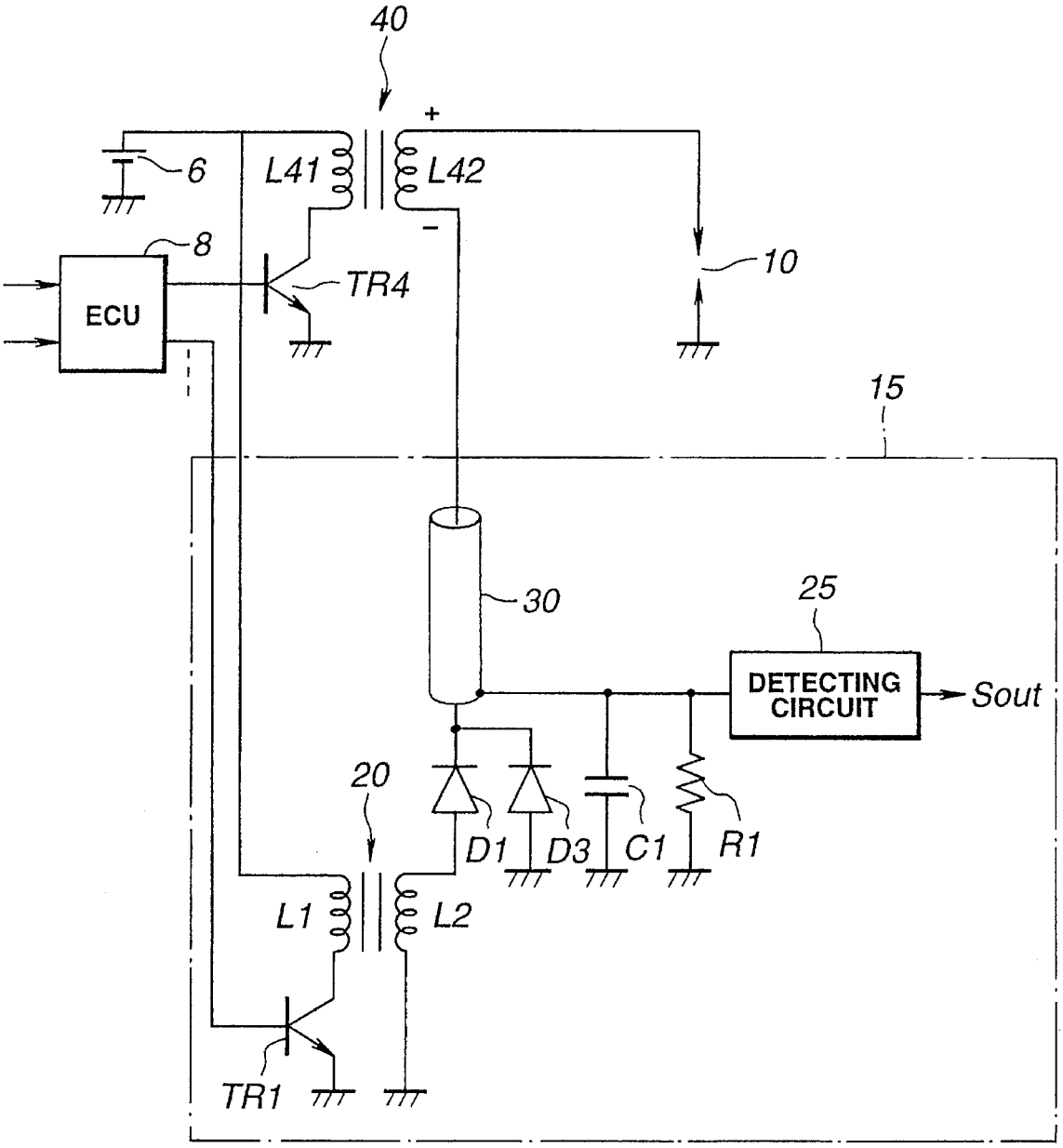
FIG. 3 is a circuit diagram of a single-ended distributorless ignition system having incorporated therein a misfire detecting device according to an embodiment of the present invention.

For example, a single-ended distributorless ignition system shown in FIG. 3 is constructed so as to apply a high voltage produced in the secondary winding L42 when the power transistor TR4 provided to a path for energization of the primary winding L41 of the ignition coil 40 is turned off, to one spark plug 10, so that it will do to apply a high voltage pulse by way of the secondary winding L42 to the spark plug 10, and therefore there is no need of providing the misfire detecting device 15' with a leakage preventing diode D2 as in the above described embodiment.

Accordingly, in the single-ended distributorless ignition system, the misfire detecting device 15' is constructed so as to directly connect the cathode of the reverse current preventing diode D1 and one side of the secondary winding L42 of the ignition coil 40, which is not connected to the spark plug 10. In this instance, if this connection is attained by using the shielding wire 30 shown in FIGS. 2A–2C and taking-in of a detection voltage is performed indirectly by using the outer conductor and the intermediate conductor, it becomes possible to obtain the same effect as the above descried embodiment.

What is claimed is:

1. A misfire detecting device for an internal combustion engine having an ignition system for interrupting flow of primary current through a primary winding of an ignition coil and thereby inducing a high voltage for ignition in a secondary winding of the ignition coil, and applying the high voltage for ignition to a spark plug provided to an internal combustion engine, the misfire detecting device comprising:

high voltage pulse producing means for producing, after spark discharge of the spark plug, a high voltage pulse which is not so high as to cause the spark plug to discharge;

voltage applying means for applying said high voltage pulse to a conductive path connecting between the secondary winding of the ignition coil to the spark plug, by way of a reverse current preventing diode and a leakage preventing diode connected to said conductive path;

voltage dividing means for dividing a voltage at a side of said reverse current preventing diode nearer to said conductive path to obtain a divided voltage;

misfire detecting means for detecting a misfire on the basis of a decay characteristic of said divided voltage obtained after application of said high voltage pulse;

wherein said reverse current preventing diode and said leakage preventing diode are connected by means of a shielding wire having an outer conductor for shielding.

2. A misfire detecting device according to claim 1, wherein said shielding wire comprises a center conductor, an outer conductor disposed around said center conductor, and an insulator interposed therebetween, said reverse current preventing diode and said leakage preventing diode being connected by means of said center conductor of said shielding wire, said voltage dividing means having a capacitor connected at one of opposite ends to said outer conductor of said shielding wire and grounded at the other of said opposite ends, and a voltage across said opposite ends of said capacitor being inputted as said divided voltage to said misfire detecting means.

3. A misfire detecting device according to claim 2, wherein said insulator comprises a first insulator section having a relatively low dielectric constant and disposed more adjacent to an outer periphery of said center conductor and a second insulator section having a relatively high dielectric constant and disposed more adjacent to an inner periphery of said outer conductor.

4. A misfire detecting device according to claim 3, wherein said first insulator section is made of an insulation material mainly containing fluororesin, and said second insulator section is made of an insulation material mainly containing silicon rubber.

5. A misfire detecting device according to claim 1, wherein said shielding wire is a double shielding wire including a center conductor, an intermediate conductor disposed around said center conductor, an outer conductor disposed around said intermediate conductor, a first insulator disposed between said center conductor and said intermediate conductor, and a second insulator disposed between said intermediate conductor and said outer conductor, said reverse current preventing diode and said leakage preventing diode being connected by means of said center conductor of said shielding wire, said voltage dividing means having a capacitor connected at one of opposite ends to said intermediate conductor and grounded at the other of said opposite ends, and a voltage across said opposite ends of said capacitor being applied as said divided voltage to said misfire detecting circuit.

6. A misfire detecting device according to claim 5, wherein said outer conductor is grounded.

7. A misfire detecting device according to claim 5, wherein said first insulator has a relatively low dielectric constant, and said second insulator has a relatively high dielectric constant.

8. A misfire detecting device according to claim 7, wherein said first insulator is made of an insulation material mainly containing fluororesin, and said second insulator is made of an insulation material mainly containing silicon rubber.

9. A misfire detecting device according to claim 1, wherein said shielding wire is a double shielding wire including a center conductor, an intermediate conductor disposed around said center conductor, an outer conductor disposed around said intermediate conductor, a first insulator disposed between said center conductor and said intermediate conductor, and a second insulator disposed between said intermediate conductor and said outer conductor, said reverse current preventing diode and said leakage preventing diode being connected by means of said intermediate conductor of said shielding wire, said voltage dividing means having a capacitor connected at one of opposite ends to said center conductor and grounded at the other of said opposite ends, and a voltage across said opposite ends of said capacitor being applied as said divided voltage to said misfire detecting means.

10. A misfire detecting device according to claim 1, wherein said shielding wire comprises a plurality of parallel center conductors, an outer conductor placed around said center conductors, and an insulator disposed between said outer conductor and said respective center conductors, said reverse current preventing diode and said leakage preventing diode being connected by means of at least one of said center conductors of said shielding wire, said voltage dividing means having a capacitor connected at one of opposite ends thereof to remaining one of said center conductors and grounded at the other of said opposite ends, and a voltage across said opposite ends of said capacitor being inputted as said divided voltage to said misfire detecting means.

11. A misfire detecting device according to claim 10, wherein said outer conductor is grounded.

12. A misfire detecting device according to claim 10, wherein said insulator comprises a first insulator section having a relatively low dielectric constant and disposed more adjacent to outer peripheries of said center conductors and a second insulator section having a relatively high dielectric constant and disposed more adjacent to an inner periphery of said outer conductor.

13. A misfire detecting device according to claim 12, wherein said first insulator section is made of an insulation material mainly containing fluororesin, and said second insulator section is made of an insulation material mainly containing silicon rubber.

14. A misfire detecting device for an internal combustion engine having an ignition system for interrupting flow of primary current through a primary winding of an ignition coil and thereby inducing a high voltage for ignition in a secondary winding of the ignition coil, and applying the high voltage for ignition to a spark plug provided to an internal combustion engine, the misfire detecting device comprising:

high voltage pulse producing means for producing, after spark discharge of the spark plug, a high voltage pulse which is not so high as to cause the spark plug to discharge;

voltage applying means for applying said high voltage pulse to a conductive path connecting between the secondary winding of the ignition coil to the spark plug, by means of a reverse current preventing diode and the secondary winding of the ignition coil;

voltage dividing means for dividing a voltage at a side of said reverse current preventing diode nearer to said conductive path to obtain a divided voltage;

misfire detecting means for detecting a misfire on the basis of a decay characteristic of said divided voltage obtained after application of said high voltage pulse;

wherein said reverse current preventing diode and the secondary winding of the ignition coil are connected by means of a shielding wire having an outer conductor for shielding.

15. A misfire detecting device according to claim 14, wherein said shielding wire comprises a center conductor, an outer conductor disposed around said center conductor, and an insulator interposed therebetween, said reverse current preventing diode and the secondary winding of the ignition coil being connected by means of said center conductor of said shielding wire, said voltage dividing means having a capacitor connected at one of opposite ends to said outer conductor of said shielding wire and grounded at the other of said opposite ends, and a voltage across said opposite ends of said capacitor being inputted as said divided voltage to said misfire detecting means.

16. A misfire detecting device according to claim 15, wherein said insulator comprises a first insulator section having a relatively low dielectric constant and disposed more adjacent to an outer periphery of said center conductor and a second insulator section having a relatively high dielectric constant and disposed more adjacent to an inner periphery of said outer conductor.

17. A misfire detecting device according to claim 16, wherein said first insulator section is made of an insulation material mainly containing fluororesin, and said second insulator section is made of an insulation material mainly containing silicon rubber.

18. A misfire detecting device according to claim 14, wherein said shielding wire is a double shielding wire including a center conductor, an intermediate conductor disposed around said center conductor, an outer conductor disposed around said intermediate conductor, a first insulator disposed between said center conductor and said intermediate conductor, and a second insulator disposed between said intermediate conductor and said outer conductor, said reverse current preventing diode and the secondary winding of the ignition coil being connected by means of said center conductor of said shielding wire, said voltage dividing means having a capacitor connected at one of opposite ends to said intermediate conductor and grounded at the other of said opposite ends, and a voltage across said opposite ends of said capacitor being applied as said divided voltage to said misfire detecting circuit.

19. A misfire detecting device according to claim 18, wherein said outer conductor is grounded.

20. A misfire detecting device according to claim 18, wherein said first insulator has a relatively low dielectric constant, and said second insulator has a relatively high dielectric constant.

21. A misfire detecting device according to claim 20, wherein said first insulator is made of an insulation material mainly containing fluororesin, and said second insulator is made of an insulation material mainly containing silicon rubber.

22. A misfire detecting device according to claim 14, wherein said shielding wire is a double shielding wire including a center conductor, an intermediate conductor disposed around said center conductor, an outer conductor disposed around said intermediate conductor, a first insulator disposed between said center conductor and said intermediate conductor, and a second insulator disposed between said intermediate conductor and said outer conductor, said reverse current preventing diode and the secondary winding of the ignition coil being connected by means of said intermediate conductor of said shielding wire, said voltage dividing means having a capacitor connected at one of opposite ends to said center conductor and grounded at the other of said opposite ends, and a voltage across said opposite ends of said capacitor being applied as said divided voltage to said misfire detecting circuit.

23. A misfire detecting device according to claim 14, wherein said shielding wire comprises a plurality of parallel center conductors, an outer conductor placed around said center conductors, and an insulator disposed between said outer conductor and said respective center conductors, said reverse current preventing diode and the secondary winding of the ignition coil being connected by means of at least one of said center conductors of said shielding wire, said voltage dividing means having a capacitor connected at one of opposite ends thereof to remaining one of said center conductors and grounded at the other of said opposite ends, and a voltage across said opposite ends of said capacitor being inputted as said divided voltage to said misfire detecting means.

24. A misfire detecting device according to claim 23, wherein said outer conductor is grounded.

25. A misfire detecting device according to claim 23, wherein said insulator comprises a first insulator section having a relatively low dielectric constant and disposed more adjacent to outer peripheries of said center conductors and a second insulator section having a relatively high dielectric constant and disposed more adjacent to an inner periphery of said outer conductor.

26. A misfire detecting device according to claim 25, wherein said first insulator section is made of an insulation material mainly containing fluororesin, and said second insulator section is made of an insulation material mainly containing silicon rubber.

* * * * *